US011446720B2

(12) United States Patent
Grosse Lordemann et al.

(10) Patent No.: US 11,446,720 B2
(45) Date of Patent: Sep. 20, 2022

(54) COOLING APPARATUS FOR COOLING A METALLIC MATERIAL AND METHOD FOR COOLING A METALLIC MATERIAL

(71) Applicant: SMS group GmbH, Düsseldorf (DE)

(72) Inventors: Frederik Grosse Lordemann, Heiligenhaus (DE); Frank Werner, Heiligenhaus (DE)

(73) Assignee: SMS group GmbH, Düsseldorf (DE)

( * ) Notice: Subject to any disclaimer, the term of this patent is extended or adjusted under 35 U.S.C. 154(b) by 102 days.

(21) Appl. No.: 17/047,053

(22) PCT Filed: Apr. 1, 2019

(86) PCT No.: PCT/EP2019/058124
§ 371 (c)(1),
(2) Date: Oct. 12, 2020

(87) PCT Pub. No.: WO2019/197182
PCT Pub. Date: Oct. 17, 2019

(65) Prior Publication Data

US 2021/0154713 A1 May 27, 2021

(30) Foreign Application Priority Data

Apr. 13, 2018 (DE) ..... 10 2018 205 619.6
Jul. 6, 2018 (DE) ..... 10 2018 211 177.4

(51) Int. Cl.
*B21B 37/74* (2006.01)
*C21D 1/667* (2006.01)
(Continued)

(52) U.S. Cl.
CPC ..... *B21B 37/74* (2013.01); *B21B 45/0233* (2013.01); *C21D 1/667* (2013.01);
(Continued)

(58) Field of Classification Search
CPC ..... B21B 37/74; B21B 45/0233; C21D 1/667; C21D 8/0263; C21D 11/005; C21D 2221/00
See application file for complete search history.

(56) References Cited

U.S. PATENT DOCUMENTS 5,909,764 A * 6/1999 Sartschev ..... B22D 11/0608 164/443
6,062,056 A 5/2000 Groch
(Continued)

FOREIGN PATENT DOCUMENTS

JP S63149954 U 10/1988
JP 2016515474 A 5/2016
(Continued)

*Primary Examiner* — Scott R Kastler
(74) *Attorney, Agent, or Firm* — Smartpat PLC

(57) ABSTRACT

A cooling apparatus for cooling a metallic material has at least one cooling beam with a plurality of coolant application elements for applying the metallic material with a coolant. In order to be able to adapt such known cooling apparatuses even more precisely to different temperature distributions across the width of the metallic material to be cooled the density of the cross-sectional areas of the outlet openings of the coolant application elements in the width direction y of the cooling beam be distributed or dimensioned according to the amount of the slope of the distribution of the temperature T(y) of the metallic material across its width before the inlet under the cooling beam. A method for cooling a metallic material so includes determining a temperature distribution of the metallic material to be cooled and producing or selecting a cooling beam to match the temperature distribution of the metallic material.

6 Claims, 3 Drawing Sheets

(51) Int. Cl.

| | |
|---|---|
| ***B21B 45/02*** | (2006.01) |
| ***C21D 8/02*** | (2006.01) |
| ***C21D 11/00*** | (2006.01) |

(52) U.S. Cl.
CPC ..... *C21D 8/0263* (2013.01); *C21D 11/005* (2013.01); *C21D 2221/00* (2013.01)

(56) References Cited

U.S. PATENT DOCUMENTS

| | | | | |
|---|---|---|---|---|
| 7,328,598 | B2 * | 2/2008 | Cramer | B21B 45/0233 266/46 |
| 2010/0132426 | A1 | 6/2010 | Baumgärtel et al. | |
| 2016/0052033 | A1 | 2/2016 | Chen et al. | |
| 2021/0154713 | A1 * | 5/2021 | Grosse Lordemann | B21B 37/74 |

FOREIGN PATENT DOCUMENTS

| | | | |
|---|---|---|---|
| WO | 2008145222 | A1 | 12/2008 |
| WO | 2014170139 | A1 | 10/2014 |
| WO | 2015113832 | A1 | 8/2015 |
| WO | 2016189903 | A1 | 12/2016 |

* cited by examiner

COOLING APPARATUS FOR COOLING A METALLIC MATERIAL AND METHOD FOR COOLING A METALLIC MATERIAL

TECHNICAL FIELD

The disclosure relates to a cooling apparatus for cooling a metallic material, in particular after rolling of the metallic material and to a method for cooling a metallic material.

BACKGROUND

A use of cooling apparatuses along with methods for the production and operation of cooling beams are generally known.

For example, WO 2016/189903 A1 discloses a binary solution, with which overcooling of the metallic material in the edge area is compensated for by providing width masking at the edges of the metallic material in conjunction with coolant collecting tanks.

European patent EP 2 155 411 B1 also discloses a solution for reducing uneven temperature distribution, in particular at the edges of a metallic material. Here as well, masks are provided for covering the edges, wherein, however, such masks can be moved or adjusted, as the case may be, in the width direction and also allow a certain amount of coolant to pass through to the edges of the material to be cooled.

European patent specification EP 2 986 400 B1 discloses a cooling beam with several chambers that can be individually applied with the coolant. Thus, different pressures or volume flows for the coolant can be adjusted across the width of the nozzle beam. In particular, the pressure or volume flow distribution of the coolant across the width of the cooling beam can be adapted to the actual temperature curve across the width of the metal material in the inlet of a cooling apparatus. With a constant density distribution of the spray nozzles on the cooling beam in the width direction, linear coolant volume flows in particular can be adjusted across the width of the cooling beam. This may be good for linear temperature distributions across the width.

However, the actual curves of temperature distribution across the width of the metallic material to be cooled or of the cooling beam, as the case may be, do not usually run purely linearly; rather, they often are degressive or progressive. In such cases, the linear distribution of the coolant in individual width sections of the cooling beam as disclosed in EP' 400 B1 is not expedient with regard to the desired greater accuracy in compensating for given temperature profiles. In particular, this can sometimes lead to undesired overcooling of the edges of the metallic material.

WO 2015/113832 A1 discloses a cooling device for cooling a metallic item, comprising: at least one cooling beam with a plurality of coolant application elements for applying a coolant to the metallic material, each coolant application element having an outlet opening with a cross-sectional area for the coolant to exit; the thickness of the cross-sectional areas of the outlet openings of the coolant application elements in the width direction of the cooling bar is distributed and dimensioned in accordance with the amount of the gradient of the distribution of the temperature of the metallic material over its width before it enters the cooling bar. The density of the cross-sectional areas is constant according to the distribution of the temperature of the metallic good over its width.

SUMMARY

The disclosure is based on the object of further developing a known use of a cooling apparatus and a known method for its production in such a manner that the cooling effect produced by the cooling apparatus on the metallic material can be better adapted to a real inlet temperature distribution.

This object with respect to the use is achieved by the subject matter as claimed.

In the context of this description, the term "density of cross-sectional areas" means the sum of the cross-sectional areas of the outlet openings of the coolant application elements per unit area of the cooling beam. In simple terms, such density designates the ratio of the outlet area for the coolant to the unit area of the cooling beam. As an alternative to the cross-sectional area of the outlet opening on the coolant application element, the term "cross-sectional area" can also mean the cross-sectional area of a spray spot on the material to be cooled.

Through the claimed distribution of the density of the cross-sectional areas according to or corresponding to, as the case may be, the amount of the slope of the distribution of the temperature of the metallic material across its width, it is possible to adapt the cooling capacity—even when the metallic material is applied with a constant coolant volume flow or coolant pressure—much more precisely to the actual temperature conditions in the metallic material. In particular, progressive or degressive temperature curves can also be compensated for or cooled, as the case may be, in a highly precise manner. If, for example, the temperature decreases towards the edges of the metallic material, the slope towards the edges becomes increasingly steeper and the density of the cross-sectional areas of the outlet openings of the coolant application elements is to be reduced accordingly. Conversely, the following applies: If, for example, the temperature rises towards the edges, more cooling is then required, which cooling is achieved by increasing the coolant outlet area of the application elements in the corresponding width ranges.

In accordance with a first exemplary embodiment, it is determined that the density of the cross-sectional areas of the outlet openings of the coolant application elements is represented or can be represented, as the case may be, by the gap between two adjacent coolant application elements projected onto the width direction of the cooling beam. Specifically, it is proposed that such projected gap in the width direction of the cooling beam is increased towards an edge of the cooling beam if the temperature of the metallic material decreases towards such edge of the cooling beam. Due to the decrease in temperature, less cooling power is then required in such width ranges, which is achieved by increasing the projected gap between individual, in particular adjacent, nozzles. This is equivalent to a reduction in the density of the cross-sectional areas of the outlet openings of the coolant application elements.

Despite the dependence between the density of the cross-sectional areas of the outlet openings and the magnitude of the slope, the density of the cross-sectional areas does not by any means need to become zero if the magnitude of the slope is zero, that is, if the temperature distribution in the width direction is constant. Typically, the density of the cross-sectional areas of the outlet openings in the width direction is then also constant across the corresponding width section, but typically not equal to zero, more precisely greater than zero.

As already mentioned above, the disclosure offers the advantage that, even if the material to be cooled is applied with a constant volume flow or a constant pressure, as the case may be, of the coolant across the width of the cooling beam, the aforementioned precise adaptation of the cooling capacity to the actual temperature profile can be achieved solely by means of the corresponding disclosed density distribution of the coolant application elements with their respective cross-sectional areas. This is not contradicted by the fact that, in addition to the disclosed distribution of the density of the cross-sectional areas of the outlet openings, the volume flow or the pressure of the coolant can also be adjusted differently in individual width ranges, in order to adapt the distribution of the coolant and the cooling capacity in the width direction to the real temperature distribution.

For this purpose, the cooling beam can preferably be designed with several individual cooling chambers, which are applied with coolant in different ways. This typically takes place via valves assigned to the individual chambers, which are individually controlled by a control unit.

The aforementioned object is further solved by a method for producing or selecting a cooling beam for a cooling apparatus. The disclosed selection of a cooling beam concerns the case where the user has a plurality of different cooling beams in stock and he has to select a suitable cooling beam for a certain application.

DETAILED DESCRIPTION

The invention is described in detail below on the basis of the specified figures in the form of exemplary embodiments. In all figures, the same technical elements are designated with the same reference signs.

Figure 1:
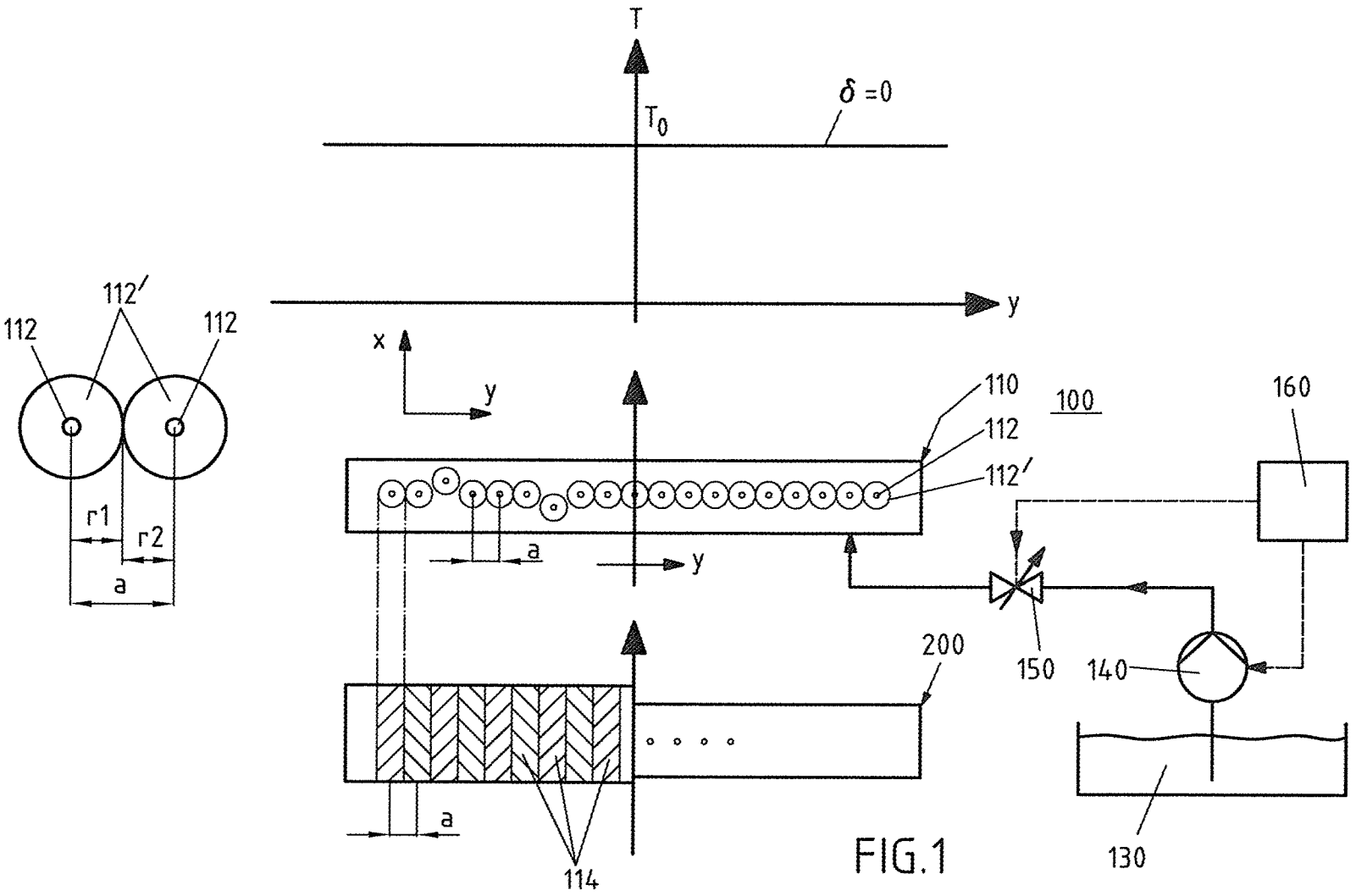
FIG. 1 shows a cooling apparatus 100 with a density distribution of the cross-sectional areas of the outlet openings of the coolant application elements in accordance with a first exemplary embodiment.

FIG. 1 shows in the middle the cooling apparatus 100 for cooling a metallic material 200, as shown in the lower partial image of FIG. 1. The cooling apparatus 100 comprises at least one cooling beam 110 with a plurality of coolant application elements 112. These can be spray nozzles, slots or U-pipes with corresponding outlet openings for the coolant. The points or small circles, as the case may be, inside the cooling beam 110 shown in FIG. 1 each represent the coolant application elements 112. The concentric circles around the coolant application elements 112 symbolize the respective cross-sectional areas 112' of the outlet openings of the coolant application elements 112. The cooling beam 110 is applied with coolant by means of a pump 140, which coolant is pumped from a tank 130 into the cooling beam with the assistance of the pump 140. The coolant is pumped via a valve 150, which is individually controlled by a control unit 160, preferably in the same manner as the pump 140. In the exemplary embodiment shown in FIG. 1, the cooling beam forms only one chamber for the coolant; accordingly, all coolant application elements 112 are applied with the same pressure or flow of coolant across the entire width of the cooling beam.

The coolant application elements 112 are arranged in FIG. 1 on the lower side of the cooling beam 110 in the form of parallel rows in the width direction. In accordance with one exemplary embodiment, this may be the case, but such row arrangement is by no means mandatory. Alternatively, the coolant application elements 112 can also be arranged randomly on the lower side of the cooling beam 110. It is also not necessary for the coolant application elements 112 to be arranged in several parallel rows; for example, the coolant application elements can also be arranged in solely one row next to each other in the width direction. Moreover, individual coolant application elements 112 can be arranged in a manner offset in the y-direction, for example. What matters is the distribution of the density of the cross-sectional areas in the width direction y of the cooling beam 110. The gap between two coolant application elements spaced in the width direction or their corresponding cross-sectional areas, as the case may be, is designated with a in FIG. 1.

In the first exemplary embodiment shown in FIG. 1, the density of the cross-sectional areas 112' of the outlet openings of the coolant application elements 112 is equally distributed in the width direction y of the cooling beam 110. Such uniform distribution is due to the uniformly distributed temperature of the metallic material across its width y shown in FIG. 1 across the cooling beam 110. Here, the temperature amounts to $T_0$ as an example and is constant across the entire width of the metallic material; that is, the slope $\delta$ of the T-distribution is zero here. In such a case, the same cooling capacity is required across the entire width of the cooling beam, but it must be unequal to zero, or more precisely, greater than zero. This is realized by the aforementioned equal distribution of the cross-sectional areas of the outlet openings of the coolant application elements. As a consequence, this means that the coolant traces on the metallic material to be cooled, which are generated by the coolant application, are preferably close to each other without an axial gap, as shown in the lower image of FIG. 1.

In general, the cross-sectional areas 112' of the outlet openings of the coolant application elements 112 on the cooling beam 110 can all be the same size, but do not have to be. For example, spray nozzles, each with a cylindrical coolant jet, can be provided as coolant application elements 112, wherein the cross-sectional areas 112 of the outlet openings of the coolant application elements 112 touch each other, as shown in FIG. 1 in a detailed figure of FIG. 1. For the constant temperature distribution and constant density distribution of the cross-sectional areas, it is recommended to use spray nozzles each with the same cross-sectional areas; their radii r1 and r2 would then be equally large. In principle, however, it is also possible to select different sizes of the cross-sectional areas, in particular with radii r1 and r2 of different sizes.

The cooling beam is produced or selected individually with regard to a given temperature distribution of the metallic material prior to entering the cooling apparatus. Different temperature distributions require different density distributions of the cross-sectional areas of the outlet openings of the coolant application elements. The following steps are to be carried out for the production:

Initially, the temperature distribution of the metallic material to be cooled must be determined across its width prior to entering under the cooling beam. Such determined temperature distribution is then to be evaluated with regard to width sections $\Delta y$, in which the temperature rises, remains constant or falls. This evaluation takes place by evaluating or determining, as the case may be, the slope of the temperature distribution. Temperature distribution is understood as a functional relationship between the temperature and the width direction of the metallic material or the cooling beam, wherein such functional relationship can be determined by interpolation of individual temperature measured values in the width direction.

The sign of the slope is of no importance; therefore, the amounts of the slopes at individual places or points, as the case may be, in the width direction must be determined. The cooling beam is then to be equipped with coolant application elements in the width direction in such a manner that the density of the cross-sectional areas of the outlet openings, that is, the density of the coolant outlet areas of the coolant application elements in the width direction of the cooling beam, is distributed and dimensioned according to the amount of the slope of the distribution of the temperature of the metallic material across its width before the inlet under the cooling beam. If the temperature rises towards the edges of the metallic material, the density of the cross-sectional areas of the outlet openings is also to be increased, because more cooling capacity is then required in the edge areas. Conversely, if the temperature decreases towards the edges of the metallic material, less cooling power is required; as such, it is sufficient to dimension the density of the cross-sectional areas there less than in the central area of the metallic material or the cooling beam, as the case may be.

Figure 2:
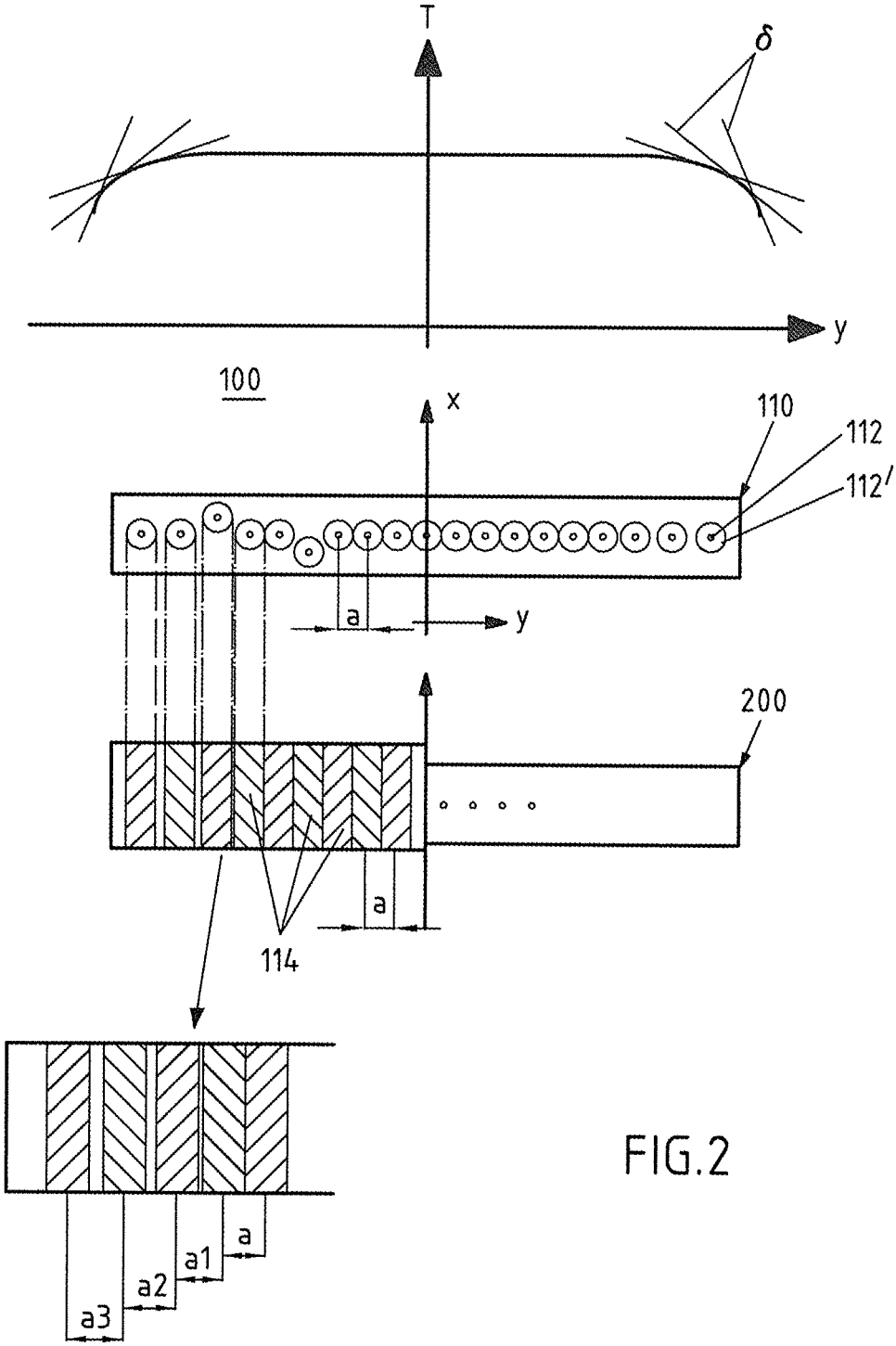
FIG. 2 shows the cooling apparatus with a cooling beam with a distribution of the density of the cross-sectional areas in accordance with a second exemplary embodiment.

FIG. 2 shows a second exemplary embodiment. It differs from the first exemplary embodiment shown in FIG. 1 in that the density of the cross-sectional areas 112' of the outlet openings of the coolant application elements 112 decreases in the width direction of the cooling beam 110 towards the edges of the cooling beam or the metallic material, as the case may be. Accordingly, in this exemplary embodiment, the edges of the metallic material are cooled less than its central area. This is due to the temperature distribution shown in the upper partial image of FIG. 2, where it can be seen that the temperature distribution decreases towards the edges. There, the slopes of the tangents to the temperature distribution are marked with δ.

In the second exemplary embodiment, the reduced density of the cross-sectional areas in the edge areas of the cooling beam is realized by increasing the gaps between the coolant traces 114 on the metallic material to be cooled towards the edges. In particular, such gaps a, a1, a2, a3 can be greater than zero; that is, the coolant tracks do not have to be directly adjacent and close to each other, but spaced apart.

Due to the increasing drop in temperature towards the edges of the metal strip 200, the gaps a, a1, a2, a3 towards the edges also become increasingly larger.

Figure 3:
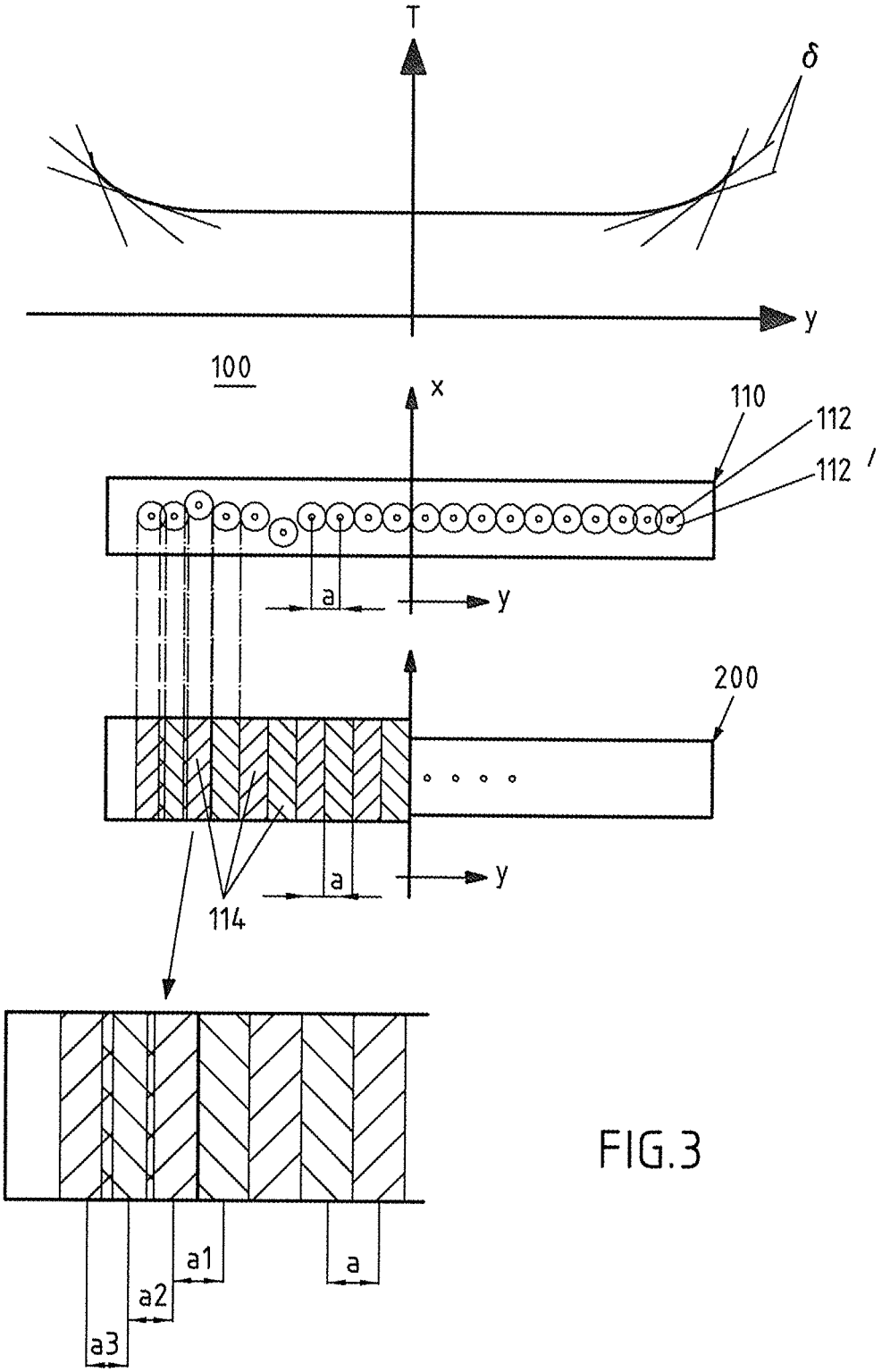
FIG. 3 shows the cooling apparatus with a cooling beam with a distribution of the density of the cross-sectional areas of the outlet openings in accordance with a third exemplary embodiment.

FIG. 3 shows a third exemplary embodiment, wherein the density of the cross-sectional areas 112' of the outlet openings of the coolant application elements 112 increases in the width direction y of the cooling beam 110. In simple terms, this means that more coolant application elements or coolant application elements with larger coolant outlet areas, as the case may be, are arranged in the edge areas. As a result, the coolant traces 114 caused by the individual coolant application elements or their coolant jets, as the case may be, on the metallic material 200 to be cooled can increasingly overlap towards the edges, as shown in the lower partial image of FIG. 3. As such, the gaps a, a1, a2, a3 become increasingly smaller towards the edges. Such aforementioned density distribution of the coolant application elements or their cross-sectional areas, as the case may be, is due to the temperature distribution shown in the upper image of FIG. 3. With this third exemplary embodiment, the temperature rises towards the edges of the metallic material compared to the central area. Here, the slope of the temperature distribution is again marked with the reference sign S.

LIST OF REFERENCE SIGNS

100 Cooling apparatus
110 Cooling beam
112 Coolant application element
112' Cross-sectional area of the outlet opening on the coolant application element
114 Coolant traces
130 Tank for coolant
140 Pump
150 Valve
160 Control unit
200 Metallic material to be cooled
a, a1, a2, a3 Gap
r1, r2 Radius of the cross-sectional areas of the outlet openings of the coolant application elements
T Temperature
x Mass flow direction or transport direction of the metallic material
y Width direction of the cooling beam and the metallic material
δ Slope of the tangent to the temperature distribution

The invention claimed is:

1. A method for cooling a metallic material (200), comprising:

determining a temperature distribution of the metallic material (200) to be cooled;

determining a slope (δ) of the temperature distribution across a width of the metallic material (200);

producing or selecting a cooling beam (110) with a plurality of coolant application elements (112) for applying a coolant to the metallic material to match the temperature distribution of the metallic material (200); and applying the coolant through the coolant application elements (112) to the metallic material, wherein each coolant application element has an outlet opening with a cross-sectional area (112') for discharging the coolant;

wherein a density of the cross-sectional areas (112') of the outlet openings of the coolant application elements (112) in a width direction (y) of the cooling beam (110) is distributed according to the slope (δ) of the temperature distribution;

wherein the density of the cross-sectional areas (112') of the outlet openings of the coolant application elements is represented by a gap (a) between two adjacent coolant application elements projected onto the width direction (y) of the cooling beam (110); and wherein the gap (a) between two adjacent coolant application elements in the width direction (y) of the cooling beam increases towards an edge of the cooling beam if the temperature of the metallic material (200) decreases towards the edge of the cooling beam (100); or wherein the gap (a) between two adjacent coolant application elements (112) in the width direction y of the cooling beam (110) becomes smaller towards an edge of the cooling beam if the temperature of the metallic material (200) increases towards such edge of the cooling beam (100).

2. The method according to claim 1, wherein the coolant application elements (112) each comprise spray nozzles with a circular cross-sectional area and cylindrical spray jet;

wherein a first spray nozzle has a cross-sectional area with a first radius (r1) and a second spray nozzle adjacent to the first spray nozzle has a cross-sectional area with a second radius (r2); and wherein in width ranges in which the slope of the temperature distribution is zero, the gap (a) between the first and the second spray nozzle projected onto the width direction of the cooling beam is: a=r1+r2.

3. The method according to claim 1, further comprising:

providing a tank (130) for the coolant;

providing a pump (140) for pumping the coolant via at least one valve (150) into the cooling beam or into individual chambers of the cooling beam; and providing a control unit (160) for individually controlling the valve (150) with respect to a desired pressure or volume flow of the coolant in the cooling beam or its chambers.

4. A method for producing or selecting a cooling beam (110) of a cooling apparatus, comprising the following steps:

determining a temperature distribution (T(y)) of a metallic material to be cooled (200) across its width (y) prior to entering under the cooling beam (110);

evaluating the temperature distribution (T(y)) with respect to width sections (Δy) of the metallic material (200) in which the temperature rises, remains constant or falls by evaluating a slope of the temperature distribution;

determining amounts of the slopes; and producing or selecting the cooling beam (110) for the cooling apparatus (100) with which a density of cross-sectional areas (112') of outlet openings of coolant application elements in a width direction (y) of the cooling beam (110) is distributed according to the amount of the slope of the distribution of the temperature of the metallic material across its width before an inlet under the cooling beam (110);

wherein the density of the cross-sectional areas (112') of the outlet openings of the coolant application elements is represented by a gap (a) between two adjacent coolant application elements projected onto the width direction y of the cooling beam (110); and wherein the gap (a) between two adjacent coolant application elements in the width direction (y) of the cooling beam increases towards an edge of the cooling beam, if the temperature of the metallic material (200) decreases towards such edge of the cooling beam (100); or wherein the gap (a) between two adjacent coolant application elements (112) in the width direction (y) of the cooling beam (110) becomes smaller towards an edge of the cooling beam as the temperature of the metallic material (200) increases towards such edge of the cooling beam (100).

5. The method according to claim 1, wherein producing or selecting a cooling beam (110) comprises selecting the cooling beam from a plurality of different cooling beams.

6. The method according to claim 1, wherein determining the temperature distribution includes interpolating measured temperature values.

* * * * *